US010168067B2

(12) United States Patent
Gokhale et al.

(10) Patent No.: US 10,168,067 B2
(45) Date of Patent: Jan. 1, 2019

(54) DETECTING AND HANDLING A BLOCKED CONDITION IN THE COIL

(71) Applicant: Lennox Industries LLC, Richardson, TX (US)

(72) Inventors: Umesh Gokhale, Irving, TX (US); Eric Berg, The Colony, TX (US); Jon Douglas, Lewisville, TX (US)

(73) Assignee: Lennox Industries Inc., Richardson, TX (US)

( * ) Notice: Subject to any disclaimer, the term of this patent is extended or adjusted under 35 U.S.C. 154(b) by 363 days.

(21) Appl. No.: 14/861,314

(22) Filed: Sep. 22, 2015

(65) Prior Publication Data

US 2017/0082308 A1 Mar. 23, 2017

(51) Int. Cl.

| | |
|---|---|
| ***F24F 11/41*** | (2018.01) |
| ***F25B 47/00*** | (2006.01) |
| ***F25B 47/02*** | (2006.01) |
| ***F25D 21/02*** | (2006.01) |
| ***F25D 21/00*** | (2006.01) |
| ***F24F 11/30*** | (2018.01) |
| ***F24F 11/62*** | (2018.01) |

(Continued)

(52) U.S. Cl.

CPC ..... *F24F 11/41* (2018.01); *F24F 11/30* (2018.01); *F24F 11/62* (2018.01); *F25B 47/006* (2013.01); *F25B 47/02* (2013.01); *F25D 21/002* (2013.01); *F25D 21/02* (2013.01); *F24F 11/42* (2018.01); *F24F 2110/30* (2018.01); *F24F 2110/40* (2018.01); *F25B 2500/04* (2013.01); *F25B 2500/19* (2013.01); *F25B 2700/11* (2013.01)

(58) Field of Classification Search

CPC ..... F25B 47/02; F25B 47/006; F25B 2313/0315; F25B 2500/04; F25B 2700/172; F25B 2700/173; F25B 2700/11; F25B 2500/19; F25D 21/002; F25D 21/006; F25D 2700/12; F25D 21/02; F24F 11/0079; F24F 2011/0087; F24F 11/30; F24F 11/41; F24F 11/62; F24F 2110/40; G05D 23/1917; Y02B 30/746

See application file for complete search history.

(56) References Cited

U.S. PATENT DOCUMENTS 4,183,223 A * 1/1980 Alsenz ..... F25D 21/002 236/51
4,439,997 A * 4/1984 Cantley ..... F25B 49/02 417/2

(Continued)

*Primary Examiner* — Crystal J Barnes-Bullock
(74) *Attorney, Agent, or Firm* — Baker Botts L.L.P.

(57) ABSTRACT

A heating, ventilation, and air-conditioning (HVAC) system comprises an outdoor unit with a fan and a coil, and a controller communicatively coupled to the fan and coil. The controller is operable to receive feedback data from the fan, where the feedback data from the fan corresponds to a power and a speed of the fan. The controller is further operable to store a fan model and a plurality of thresholds and determine a virtual sensor measurement, based at least in part upon the feedback data from the fan and the fan model. The controller is operable to determine that the virtual sensor measurement is greater than a frost threshold or a fouling threshold. The controller is finally operable to, in response to determining that the pressure difference is greater than the frost threshold or the fouling threshold, determine a blocked condition on the coil.

17 Claims, 4 Drawing Sheets

(51) Int. Cl.

| | |
|---|---|
| *F24F 110/40* | (2018.01) |
| *F24F 110/30* | (2018.01) |
| *F24F 11/42* | (2018.01) |

(56) References Cited

U.S. PATENT DOCUMENTS

| | | | | | |
|---|---|---|---|---|---|
| 4,573,326 | A * | 3/1986 | Sulfstede | F25D 21/006 | 62/128 |
| 5,440,895 | A * | 8/1995 | Bahel | F24F 11/0009 | 62/211 |
| 6,354,093 | B2 * | 3/2002 | Davis | F25D 21/006 | 62/127 |
| 6,467,282 | B1 * | 10/2002 | French | F25D 21/006 | 62/140 |
| 6,994,620 | B2 * | 2/2006 | Mills | F24F 11/30 | 454/255 |
| 7,845,179 | B2 * | 12/2010 | Singh | F25B 49/005 | 62/129 |
| 7,895,850 | B2 * | 3/2011 | Kitsch | F25B 13/00 | 62/150 |
| 8,346,507 | B2 * | 1/2013 | Shahi | F25B 49/005 | 702/182 |
| 2005/0247194 | A1 * | 11/2005 | Kang | B01D 46/0086 | 95/19 |
| 2006/0058924 | A1 * | 3/2006 | Shah | B01D 46/0086 | 700/276 |
| 2008/0034777 | A1 * | 2/2008 | Copeland | F25B 13/00 | 62/323.1 |
| 2008/0307803 | A1 * | 12/2008 | Herzon | F24F 3/147 | 62/93 |
| 2011/0302937 | A1 * | 12/2011 | Bujak, Jr. | F25B 47/02 | 62/80 |
| 2013/0086929 | A1 * | 4/2013 | Senf, Jr. | F25B 47/02 | 62/80 |
| 2015/0082817 | A1 * | 3/2015 | Stark | F25D 21/125 | 62/82 |
| 2015/0089966 | A1 * | 4/2015 | Qu | F25D 21/006 | 62/80 |
| 2015/0204589 | A1 * | 7/2015 | Liu | F25B 47/02 | 62/80 |

* cited by examiner

DETECTING AND HANDLING A BLOCKED CONDITION IN THE COIL

TECHNICAL FIELD

This disclosure relates generally to heating, ventilation, and air conditioning systems (HVAC) with an outdoor heat exchanger and, more specifically, a system for detecting and handling a blocked condition in the coil of an outdoor heat exchanger.

BACKGROUND

Heating, ventilation, and air conditioning (HVAC) systems can be used to regulate the environment within an enclosed space or structure. Outside units of the HVAC system may accumulate dirt and/or frost due to the fact that they are outside of the enclosed space or structure. Fouling or frosting of the coils on an outside unit of the HVAC system may impede air flow past the coil and reduce the capacity and efficiency of the HVAC system.

SUMMARY

In one embodiment, a heating, ventilation, and air-conditioning (HVAC) system comprises an outdoor unit, which comprises a fan and a coil, and a controller communicatively coupled to the fan and the coil. The controller is operable to receive feedback data from the fan of the HVAC system, where the feedback data from the fan corresponds to a power and a speed of the fan. The controller is further operable to store a fan model and a plurality of thresholds and determine a virtual sensor measurement, based at least in part upon the feedback data from the fan and the fan model. The controller is operable to determine that the virtual sensor measurement is greater than a frost threshold or a fouling threshold. The controller is finally operable to, in response to determining that the virtual sensor measurement is greater than the frost threshold or the fouling threshold, determine a blocked condition on the coil.

In one embodiment, a controller for a heating, ventilating, and cooling (HVAC) system, comprises an interface, a memory, and a processor. The interface is configured to receive feedback data from a fan of the HVAC system, where the feedback data from the fan corresponds to a power and a speed of the fan. The memory is operable to store a fan model and a plurality of thresholds. The processor is communicatively coupled to the memory and the interface and is operable to determine a virtual sensor measurement based at least in part upon the feedback data from the fan and the fan model. The processor may be further operable to determine that the virtual sensor measurement is greater than at least one of a frost threshold and a fouling threshold. The processor may finally be operable to, in response to determining that the virtual sensor measurement is greater than at least one of the frost threshold and the fouling threshold, determine a blocked condition on the coil.

Certain embodiments of the present disclosure may provide one or more technical advantages. For example, calculating a virtual sensor measurement of the outdoor unit of an HVAC system is independent of weather conditions and quantifies in real-time the amount of frost growth on the coil. This may prevent a false alert of a frost growth as compared to, for example, just using the coil temperature to estimate the amount of frost on a coil. Using the virtual sensor measurement prevents false alerts and avoids unnecessary defrost cycles, thus conserves resources and increasing efficiency of the HVAC system. In some embodiments, the virtual sensor measurement may be used to terminate a defrost cycle once the frost growth has been melted, thus preserving resources that would have been used to run the defrost cycle for a predetermined amount of time.

Certain embodiments of the disclosure may include none, some, or all of the above technical advantages. One or more other technical advantages may be readily apparent to one skilled in the art from the figures, descriptions, and claims included herein. Moreover, while specific advantages have been enumerated above, various embodiments may include all, some, or none of the enumerated advantages.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION OF THE DRAWINGS

When the coil of the outside unit (e.g., the condenser coil) becomes dirty or frosted, at least a part of the coil blocks air flow. This creates a less efficient HVAC system because less air will flow past the coil. It is often difficult to ascertain how much the coil is blocked without inspecting the outside unit in person. Thus, detecting a real-time collection of frost on or fouling of the outdoor coil would be beneficial to ensure the HVAC system is operating properly and efficiently. By using data from the fan of the outdoor unit, such as the fan speed (e.g., revolutions per minute (RPM)) and power or torque, the HVAC system can estimate the amount of frost or fouling on the outdoor coil. The HVAC system may also use the real-time condition information to handle the blocked condition, such as running a defrost cycle to remove the frost from the coil and/or generate an alert that the coil needs to be cleaned. Because either power or torque can be used to estimate the amount of frost or fouling on the outdoor coil, any description or example embodiment using power should be understood as being operable to use torque and should not be construed as limiting.

Although the present disclosure has been described with several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

Figure 1:
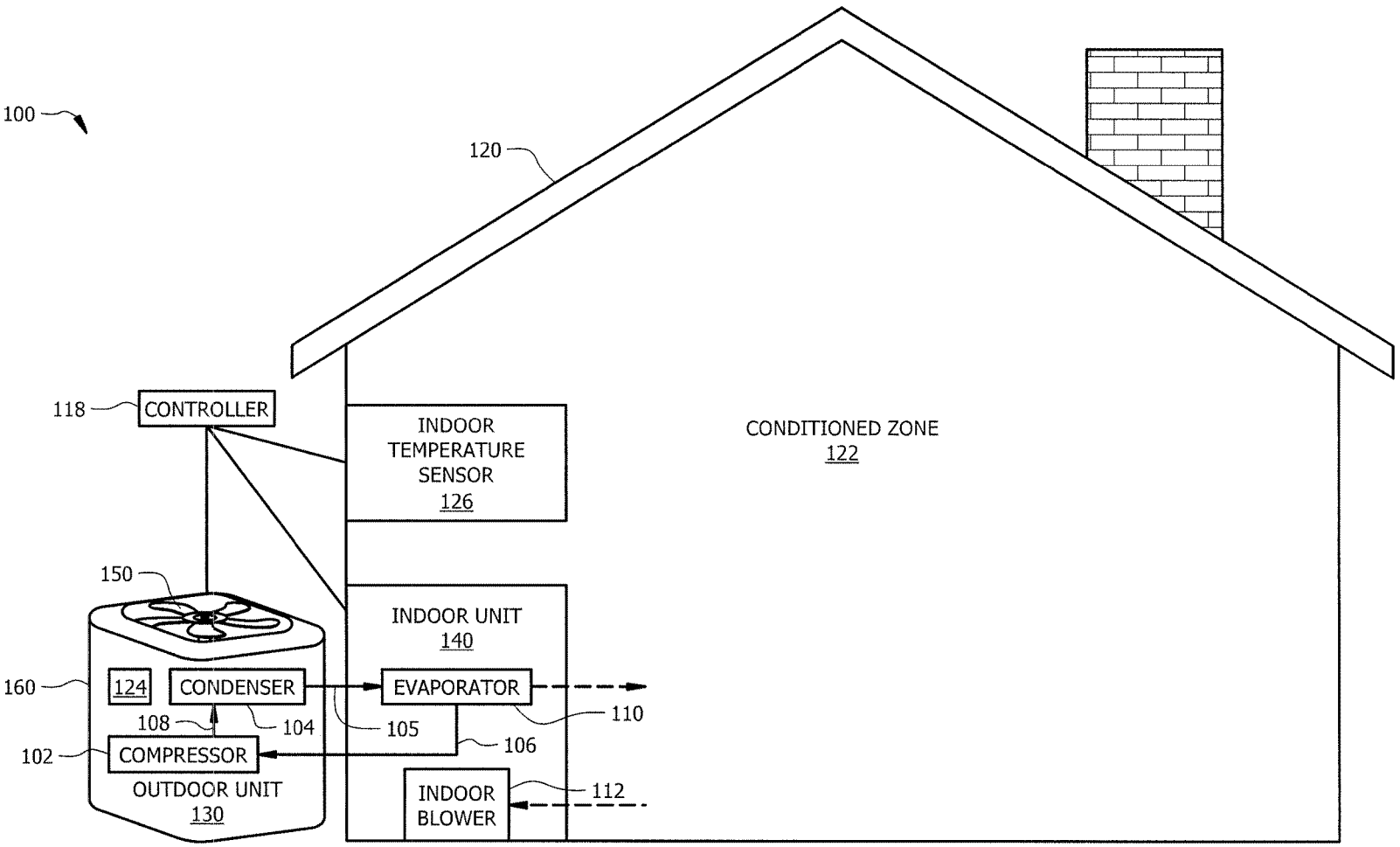
FIG. 1 illustrates a block diagram of an example HVAC system 100 for providing conditioned air to a structure.

FIG. 1 illustrates a block diagram of an example HVAC system 100 for providing conditioned air to a structure. HVAC system 100 may be configured for use with refrigerant as part of vapor compression cycle operation. HVAC system 100 may provide heating, ventilation, or cooling supply air to a space. Although FIG. 1 shows HVAC system 100 being a residential split system, HVAC system 100 may be used in residential or commercial buildings, and in refrigeration, and thus the embodiment shown in FIG. 1 should not be construed as limiting. In an embodiment, HVAC system 100 may be a heat pump unit, a heating only unit, a cooling only unit, a Variable Refrigerant Flow (VRF) unit, or the like. Additionally, HVAC system 100 may be a single stage, multi-stage unit, or variable capacity unit.

In certain embodiments, HVAC system 100 comprises outdoor unit 130, controller 118, and structure 120, which contains indoor unit 140 and conditioned zone 122. Outdoor unit 130 may comprise compressor 102, condenser 104, suction line 106, discharge line 108, outdoor temperature sensor 124, fan 150, and coil 160. Indoor unit may comprise indoor blower 112 and evaporator 110. Conditioned zone 122 may comprise an indoor temperature sensor 126. In some embodiments, when HVAC system 100 is in a cooling mode, compressor 102 may receive refrigerant from suction line 106 and compress the refrigerant and discharge the refrigerant through discharge line 108. From discharge line 108, the refrigerant may be cooled by condenser 104, flow through liquid line 105 including an expansion device, and be heated by evaporator 110 before returning to suction line 106 to flow through the refrigerant loop again. In some embodiments, when HVAC system 100 is in a heating mode, evaporator 110 may be configured to operate as a condenser and condenser 104 may be configured to operate as an evaporator as part of the vapor compression cycle, with the refrigerant flow directed in the opposite direction than described for cooling mode. In some embodiments, indoor blower 112 may comprise a fan to blow air over evaporator 110 such that air is circulated to conditioned zone 122 of structure 120.

Outdoor unit 130, in some embodiments, comprises fan 150. In some embodiments, fan 150 may be a variable speed fan, which outputs air out of the condenser at variable speeds and allows outside air to enter the condenser at multiple speeds. The speed of fan 150 may be expressed in terms of cubic feet per minute (CFM), rotational rate of the fan motor per minute (RPM), or any suitable units. Fan 150 may also have a fan motor which controls the rate of the air flow. Fan 150 may be communicatively coupled to controller 118 such that controller 118 may receive data regarding the current speed, power, torque, or any related measurement of fan 150 and may transmit signals to change the speed or power of fan 150.

In some embodiments, outdoor unit 130 includes coil 160. Because coil 160 is exposed to the outside environment, it may be prone to dirt, debris, lint, or other particles becoming stuck to coil 160. Coil 160 is exposed to weather conditions and thus may develop frost when the ambient air surrounding outside unit 160 is cold or below freezing. If coil 160 accumulates dirt, frost, or other particles, then the airflow of outside unit 130 may be at least partially blocked. In cooling mode, this may cause higher condenser pressures and inefficiencies in outdoor unit 130 condensing refrigerant. For example, the liquid coming out of condenser 104 may be at a higher temperature, which results in a lower refrigeration effect in evaporator 110. In heating mode, coil 160 operates as the evaporator and dirt, frost, or other particles blocking coil 160 may cause lower evaporator pressures and inefficiencies in outdoor unit 130. In some embodiments, coil 160 may include a sensor for determining the coil temperature.

In some embodiments, outdoor temperature sensor 124 and indoor temperature sensor 126 may be thermistors, thermocouples, resistive temperature devices, infrared sensors, thermometers, or any device configured to sense the temperature of the air surrounding the sensor. In some embodiments, outdoor temperature sensor 124 and indoor temperature sensor 126 may be configured to transmit one or more signals to controller 118 indicating the respective temperature data sensed by outdoor temperature sensor 124 and indoor temperature sensor 126. Outdoor temperature sensor 124 may, in various embodiments, comprise a sensor to measure the temperature outside of structure 120 that HVAC system 100 is heating or cooling. In some embodiments, indoor temperature sensor 124 may comprise a sensor to measure the temperature in conditioned zone 122 of structure 120 that HVAC system 100 is heating or cooling.

Controller 118 may be connected to HVAC system 100 components via wired or wireless connections and may, in various embodiments, comprise any suitable system, device, or apparatus for controlling, monitoring, protecting, and/or configuring HVAC system 100 components. Controller 118 may be implemented with control logic for selectively turning on or turning off one or more HVAC system 100 components in response to demands on HVAC system 100, user input, and data received from sensors. In some embodiments, controller 118 may determine a blocked condition on outside coil 160 in response to feedback from at least fan 150.

In some embodiments, controller 118 may be provided with one or more internal components configured to perform one or more of the functions of a memory, a processor, and/or an input/output (I/O) interface. Controller 118 memory may store computer executable instructions, operational parameters for system components, calibration equations, predefined tolerance values, or ranges, for HVAC system 100 operational conditions, a number of thresholds, and the like. The memory of controller 118 may also store a plurality of thresholds for HVAC system 100, such as a dirt threshold, a frost threshold, and a no-frost threshold. These thresholds may vary depending upon the speed (RPM) of fan 150. Depending on the speed of fan 150, controller 118 may select an appropriate threshold to which to compare the virtual sensor measurement (VSM). Controller 118 processor may execute instructions stored within controller 118 memory. Controller 118 I/O interface may operably connect controller 118 to HVAC system 100 components such as compressor 102, outdoor temperature sensor 124, fan 150, coil 160, and indoor temperature sensor 126.

In some embodiments, controller 118 may be configured to provide status information indicating HVAC system 100 components operation and performance. Controller 118 may comprise a display screen, one or more LEDs, a speaker, or some other similar device capable of indicating status information to a user of the HVAC system 100. Additionally, controller 118 may be configured to transmit status information to one or more devices or systems remote to the HVAC system 100.

Controller 118 may, in some embodiments, be implemented with logic for monitoring and/or reconfiguring operation of HVAC system 100 components. Controller 118 may receive data from one or more remote devices, such as outdoor temperature sensor 124, indoor temperature sensor 126, and fan 150. Controller 118 may receive data from one or more remote devices indicating status information. For example, controller 118 may receive status information indicating whether compressor 102 is turned on or turned off. The data received by controller 118 may comprise signals from one or more remote devices. Controller 118 may receive one or more signals directly from one or more remote devices. Controller 118 may receive one or more signals indirectly from one or more remote devices, such as through one or more intermediate devices. The one or more intermediate devices may comprise signal converters, processors, input/output interfaces, amplifiers, conditioning circuits, connectors, and the like.

In some embodiments, controller 118 receives feedback data from fan 150 in order to determine a pressure difference across coil 160. Controller 118 may store a number of fan maps, an example of which is described in FIG. 2 below, in its memory. Using the fan maps along with fan law equations, which are used to predict a fan's performance at other conditions, controller 118 may determine the value of the VSM (e.g., static pressure drop across coil 160). Examples of fan equations used include:

$$CFM_2=CFM_1(RPM_2/RPM_1) \quad \text{(Equation 1)}$$

$$SP_2=(RPM_2/RPM_1)^2*SP_1 \quad \text{(Equation 2)}$$

$$BHP_2=(RPM_2/RPM_1)^3*BHP_1 \quad \text{(Equation 3)}$$

Equation 1 outputs the volume (cubic feet per minute) of fan 160, which varies directly with a speed ratio ($RPM_2/RPM_1$). Equation 2 outputs a static pressure, which varies with the squared value of the speed ratio ($RPM_2/RPM_1$). Equation 3 outputs the brake horsepower (BHP) of fan 160, which varies with the cubed value of the speed ratio ($RPM_2/RPM_1$). A virtual sensor is developed by applying the above fan laws on empirically collected system data. The virtual sensor uses the following equation to determine a virtual sensor measurement (VSM):

$$VSM=K_1*(RPM)+K_2*Power+K_3*(RPM^2)+K_4*(Power^2)+K_5 \quad \text{(Equation 4)}$$

The virtual sensor measurement (VSM), for example, may be representative of a static pressure drop across coil 160, or any other measurement indicating that coil 160 is frosted, dirty, fouled, or partially blocked. RPM is the revolutions per minute of fan 150 (e.g., speed) and Power is the power consumed by fan 150. These two values may be received by controller 118 or determined by controller 118 using feedback data from fan 150. In some embodiments, controller 118 may use a torque measurement rather than a power measurement, depending on the data that fan 150 delivers to controller 118. $K_1$-$K_5$ are coefficients unique to a given a model of fan 150 and coil 160, and would change depending on whether the equations use torque or power. Coefficients $K_1$-$K_5$ are parameters developed from testing of HVAC systems. For example, specific models of fan 150 and coil 160 may be tested in a lab at a variety of conditions. This data may be used to generate a curve (i.e., fan model). Coefficients $K_1$-$K_5$ may vary depending on the current model of fan 150. For example, controller 118 may store the coefficients for various fan models and, based on its knowledge of the current fan model in HVAC system 100, may determine the coefficients corresponding to that model. Controller 118 may use the RPM and power values either received from fan 150 or determined using feedback data from fan 150 to calculate the VSM across coil 160.

In some embodiments, controller 118 uses this VSM value to determine fouling or frosting of coil 160. Controller 118 may use thresholds such as a dirt threshold and a frost threshold to compare the VSM to in order to determine whether coil 160 requires a defrost cycle or cleaning.

Modifications, additions, or omissions may be made to the systems described herein without departing from the scope of the disclosure. For example, HVAC system 100 may include any number of controllers 118, outdoor temperature sensor 124, suction lines 106, discharge lines 108, and compressors 102. The components may be integrated or separated. Moreover, the operations may be performed by more, fewer, or other components. Additionally, the operations may be performed using any suitable logic comprising software, hardware, and/or other logic.

Figure 2:
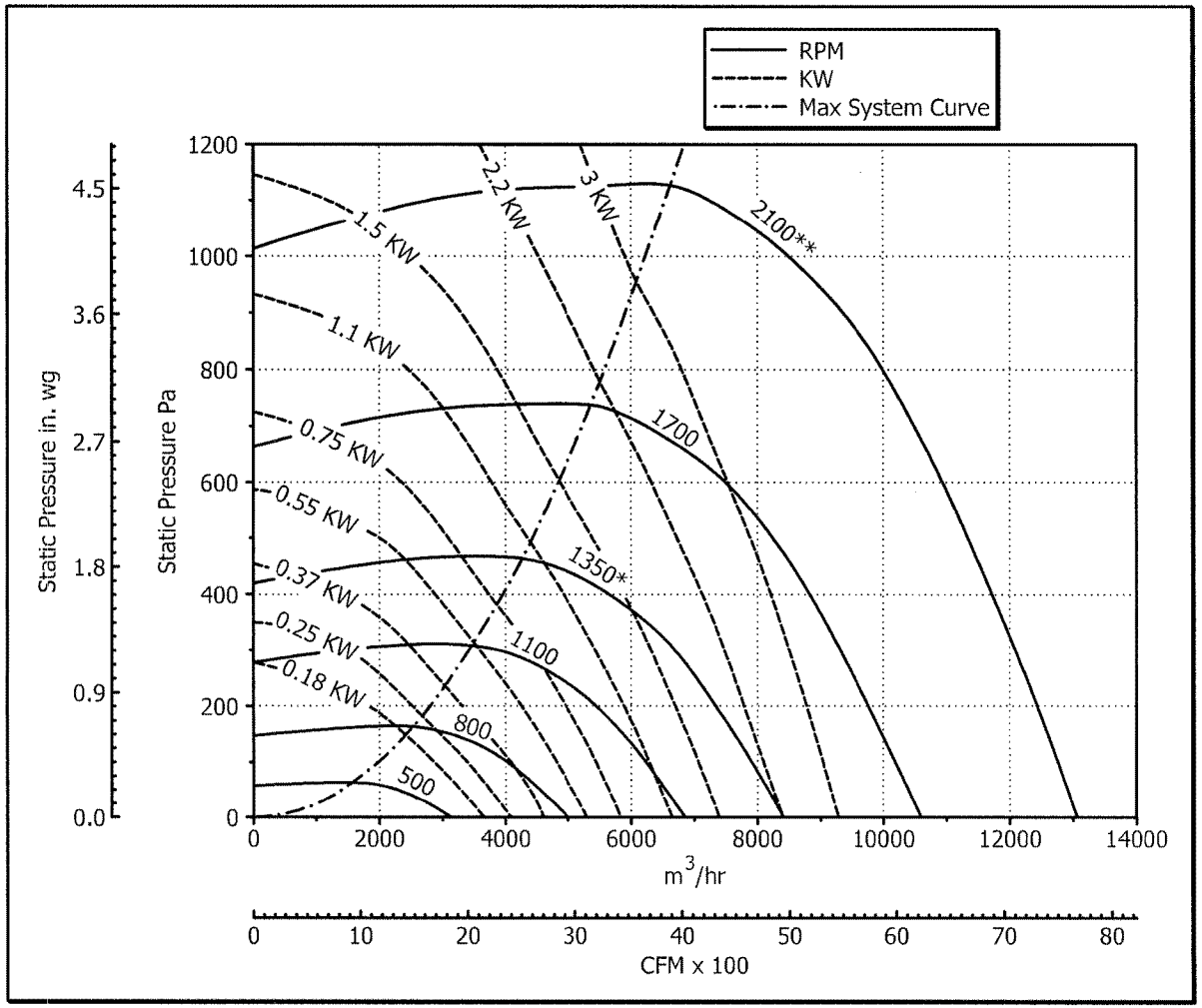
FIG. 2 illustrates an example of a fan map to determine the virtual sensor measurement.

FIG. 2 illustrates an example of a fan map to determine VSM drop across coil 160. As discussed above, controller 118 may use feedback data from fan 150 to determine the speed (RPM) and power of fan 150 and use those values to determine the VSM. The x-axis of FIG. 2 shows the volume of fan 150 in units of meters cubed per hour. The dotted lines in the graph shows the power of fan 150 in units of kilowatts (KW). The solid lines on the graph indicate the speed of fan 150 in units of RPM. Using this curve as well as the current power and speed of fan 150, controller 118 may determine the VSM. Based on the arrangement of HVAC system 100, the VSM may be caused by the pressure drop across coil 160 of outdoor unit 130. For example, fan 150 creates a pressure drop by pulling air through outdoor coil 160. FIG. 2 illustrates but one example of a fan map. HVAC system 100 may include any number of fan maps such that controller 118 can determine the VSM drop across coil 160.

Figure 3:
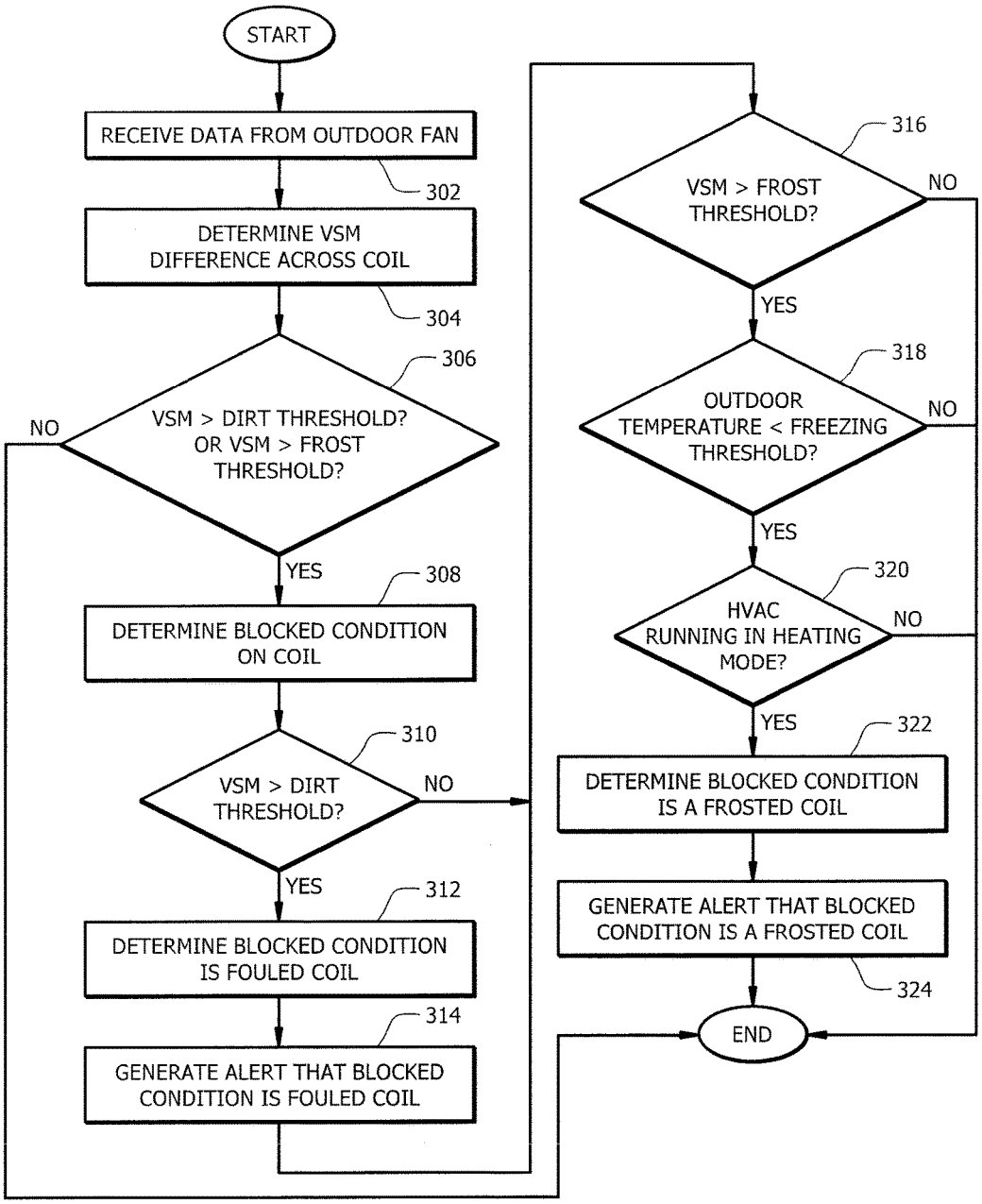
FIG. 3 illustrates a flowchart describing an example of detecting and handling a blocked condition in the coil of an outside unit.

FIG. 3 illustrates a flowchart describing an example of detecting and handling a blocked condition in the coil of an outside unit. To illustrate examples of handling a blocked condition in the coil, the steps of FIG. 3, described below, discuss components of FIG. 1 and FIG. 2, although other components not illustrated in FIG. 1 and FIG. 2 may be used. Controller 118 may perform this method as a way to allow HVAC system 100 to detect and handle a blocked condition in the coil.

At step 302, in some embodiments, controller 118 receives feedback data from fan 150 of HVAC system 100. The feedback data from fan motor 150 may include such data as a power value and a speed value of fan 150. Fan 150 may be operably connected to controller 118 via wired or wireless connections. Fan 150 may transmit one or more signals comprising feedback data, or alternatively component status data to controller 118.

At step 304, in some embodiments, controller 118 determines the static pressure difference across coil 160 based at least in part on the feedback data from step 302 and a fan model stored in the memory of controller 118. As described above with regard to FIG. 1 and FIG. 2, a fan model may be stored in the memory of controller 118 and be used to determine the static pressure difference.

At step 306, in some embodiments, controller 118 determines whether the static pressure difference across coil 160 (e.g., that was determined at step 304), is greater than either a dirt threshold or is greater than a frost threshold. Controller 118 may store the dirt threshold and the frost threshold in its memory. The dirt threshold and frost threshold may vary depending on the operation, equipment, and conditions of HVAC system 100. Examples of a VSM dirt threshold include 0.02, 0.03, 0.04, and 0.05 inches of water, or any VSM values in the range of 0.02-0.05 inches of water. Examples of a frost threshold include 0.04, 0.06, 0.08, and 0.1 inches of water, or any VSM values in the range of 0.04-0.1 inches of water. Controller 118 may compare the VSM determined at step 304 to both the dirt threshold and the frost threshold to determine whether the VSM is greater than either of those thresholds.

If, at step 306, controller 118 determines that the VSM of coil 160 is not greater than a dirt threshold and is not greater than a frost threshold, the method ends. If, at step 306, controller 118 determines either that the VSM is greater than the dirt threshold (e.g., the VSM of 0.06 inches of water is greater than the dirt threshold of 0.04 inches of water) or the VSM is greater than the frost threshold (e.g., the VSM of 0.11 inches of water is greater than the frost threshold of 0.09 inches of water), then at step 308 controller 118 determines that there is a blocked condition on coil 160. In some embodiments, controller 118 may determine generally that there is a block condition and not specify whether it is a fouled coil or a frosted coil. In certain embodiments, controller 118 may determine or specify which threshold the VSM was greater than. In some embodiments, controller 118 may also generate an alert. For example, controller 118 may display an alert regarding a blocked condition on coil 160 on its interface, which may inform the user or owner of structure 120 that further action is required in order to remedy the blocked condition of coil 160. If controller 118 determines there is a blocked condition at step 308, the method continues to step 310.

At step 310, in some embodiments, controller 118 determines whether the VSM is greater than the dirt threshold. Although previously the VSM and dirt threshold were compared at step 306, controller 118 may further compare these values in order to determine whether the blocked condition is frosted coil or fouled coil. In some embodiments, step 310 can be performed using one or more of the techniques discussed above with respect to step 306.

If at step 310, controller 118 determines that the VSM is not greater than the dirt threshold, the method continues to step 316, which is described below. If at step 310, controller 118 determines that the VSM is greater than the dirt threshold, then at step 312, controller 118 determines that the blocked condition is a fouled coil. Controller 118, in some embodiments, may generate an alert to the blocked condition of the fouled coil in step 314. For example, controller 118 may display on its interface that coil 160 is fouled. Controller 118 may transmit the alert to a manufacture of HVAC system 100 and/or a maintenance entity that coil 160 is fouled. This may allow for a maintenance person to travel to the site of structure 120 in order to personally clean out coil 160.

If, at step 310, controller 118 determines that the VSM is not greater than the dirt threshold, then at step 316, controller 118, in some embodiments determines whether the VSM is greater than the frost threshold. In some embodiments, step 316 can be performed using one or more of the techniques discussed above with respect to step 306 and 310. If at step 316, controller 118 determines that the VSM is not greater than the frost threshold and method ends. If the controller 118 determines the VSM is greater than the frost threshold, then the method continues to step 318. Controller 118 may use steps 318 and 320 to ensure that the VSM reading indicates a frost threshold. For example, frost on coil 160 will only develop in certain conditions. Thus, if the VSM is greater than the frost threshold, and yet if those conditions as described in step 318 and 320 are not met, then controller 118 may determine that the VSM calculation is incorrect or that there is some other issue with HVAC system 100 rather than initiate a defrost cycle. This prevents unnecessary defrost cycles from occurring, which saves resources and allows for more efficient operation of HVAC system 100.

At step 318, in some embodiments, controller 118 determines whether the outdoor temperature is less than the freezing threshold. Controller 118 may receive an outdoor temperature measurement from outdoor temperature sensor 124. This measurement indicates the ambient air temperature surrounding outside unit 130. For example, controller 118 may determine that the outdoor temperature is 50 degrees Fahrenheit, which may be more than, for example, a freezing threshold of 32 degrees Fahrenheit. If, at step 318, controller 118 determines that the outdoor temperature is not less than the freezing threshold, then the method ends. If at step 318, controller 118 determines that the outdoor temperature (e.g., 25 degrees) Fahrenheit is less than a freezing threshold (e.g., 32 degrees Fahrenheit) then the method continues to step 320.

At step 320, in some embodiments, controller 118 determines whether HVAC system 100 is running in a heating mode. In some embodiments, controller 118 continually has knowledge of the current mode of HVAC system 110. In certain embodiments, controller 118 may receive feedback from various parts of HVAC system 100, including indoor temperature sensor 126, outdoor unit 130, condenser 104, compressor 102, indoor unit 140, evaporator 110, and conditioned zone 120 to determine the current mode. If controller 118 determines HVAC system 100 is not running in heating mode, the method ends. If HVAC system 100 is not in heating mode, this indicates that the VSM being greater than the frost threshold is not resulting in a frosted coil 160 (i.e., this was a false positive for a blocked condition due to frost on coil 16). Similarly, at step 318, frost cannot develop unless the outdoor temperature is less than a freezing threshold. If controller 118 determines at steps 318 and 320 that the outdoor temperature is less than a freezing threshold and HVAC system 100 is running in a heating mode, then at step 322, controller 118 determines that the blocked condition from step 308 is the result of a frosted coil 160.

At step 324, in some embodiments, controller 118 generates an alert regarding the blocked condition of coil 160 due to frost build up on coil 160. In some embodiments, step 324 can be performed using one or more of the techniques discussed above with respect to step 314. For example, the alert may display on an interface of controller 118 to indicate coil 160 is frosted. As another example, the alert may be transmitted to the manufacturer of HVAC system 100 or to a maintenance entity so that the blocked condition can be remedied. After this the method ends.

Modifications, additions, or omissions may be made to the methods described in FIG. 3 without departing from the scope of the disclosure. For example, the steps may be combined, modified, or deleted where appropriate, and additional steps may be added. For example, if controller 118 determines that the VSM is greater than the dirt threshold at step 310, then steps 316-324 may be omitted. Additionally, the steps may be performed in any suitable order without departing from the scope of the present disclosure. While discussed as controller 118 performing the steps, any suitable component of HVAC system 100 may perform one or more of the steps.

Figure 4:
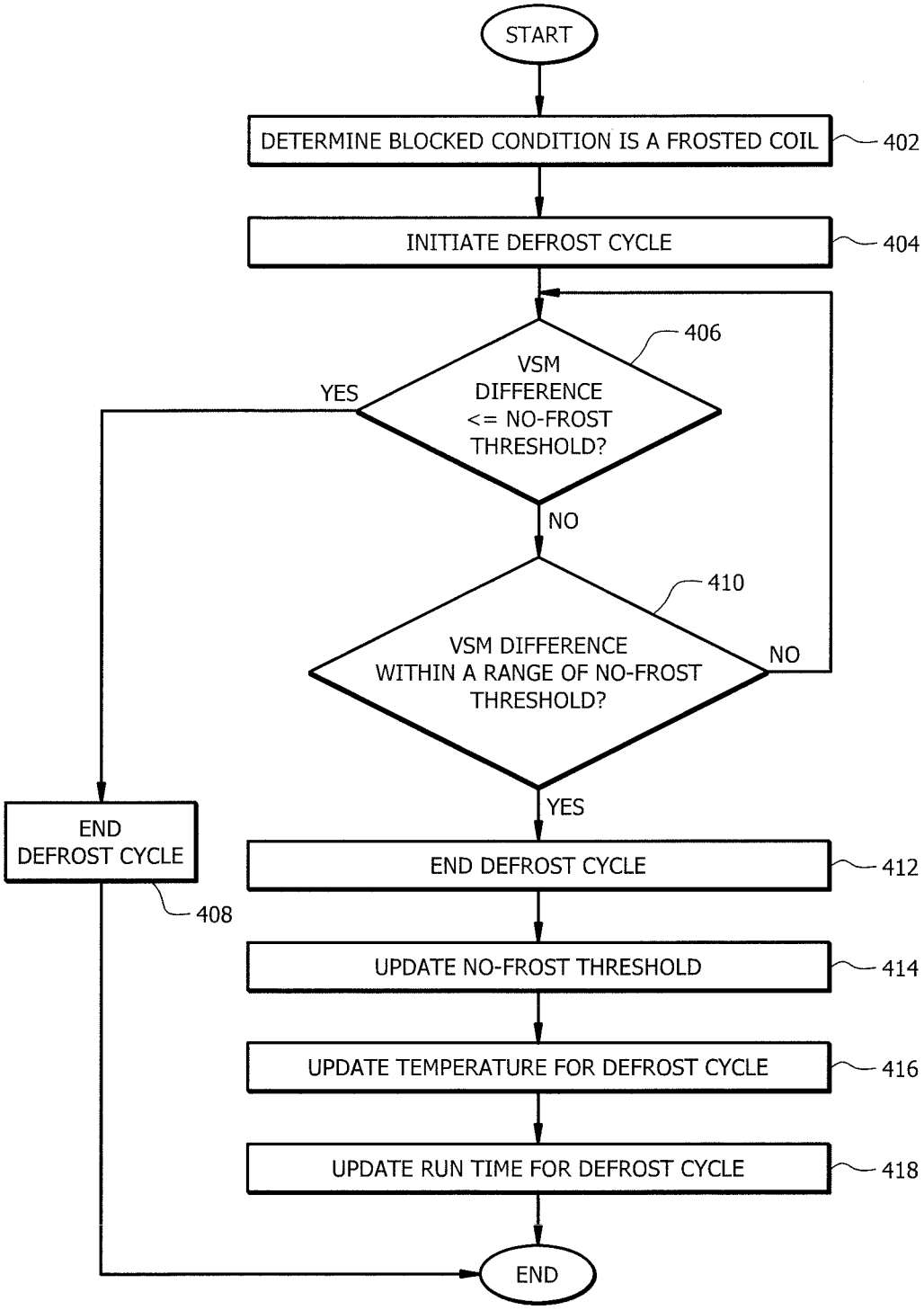
FIG. 4 illustrates a flowchart describing an example of detecting and handling a frosted coil of an outside unit.

FIG. 4 illustrates a flowchart describing an example of detecting and handling a frosted coil of an outside unit. To illustrate examples of detecting and handling a frosted coil of an outside unit, the steps of FIG. 4, described below, discuss components of FIG. 1 and FIG. 2, although other components not illustrated in FIG. 1 and FIG. 2 may be used. Controller 118 may perform this method as a way to allow HVAC system 100 to detect and handle a blocked condition in the coil.

At step 402, in some embodiments, controller 118 determines that a blocked condition is frost on coil 160. In some embodiments, step 402 can be performed using one or more of the techniques discussed above with respect to steps 306, 308 and 316-322 as described above in FIG. 3. In general, steps 404-418 illustrate the steps HVAC system 100 may take to remedy frosted coil 160.

At step 404, in some embodiments, controller 118 initiates a defrost cycle in order to remove the frost from coil 160. Controller 118 may turn on a heater of outdoor unit 130 in order to melt the frost that accumulated on coil 160. Controller 118 may run the defrost cycle at a certain temperature and/or for a certain period of time. In some embodiments, the defrost cycle may last for between 2 and 14 minutes with the heat pumps at a temperature of between 50 and 90 degrees Fahrenheit. For example, controller 118 may have preset conditions such as running the defrost cycle at 70 degrees Fahrenheit for 5 minutes. As the temperature increases, the amount of time that the cycles needs to run for decreases. For example, controller 118 may heat coil 160 to 50 degrees Fahrenheit and having a run time of five minutes. As another example, defrost cycle conditions may include heating coil 160 to 75 degrees Fahrenheit and having a run time of only three minutes. Controller 118 may have these defrost cycle conditions stored in its memory and they also may be updated (e.g., increased and/or decreased) as needed according to energy and efficiency requirements for HVAC system 100. In some embodiments, fan 150 may be off during the defrost cycle, and the cycle may be terminated once a termination temperature is reached on coil 160.

At step 406 in some embodiments, controller 118 determines whether the VSM is less than or equal to a no-frost threshold. This no-frost threshold may indicate that there is no frost accumulated on coil 160. This threshold may be stored in the memory of controller 118 and may be periodically updated due to other dirt or fouling on coil 160, as described below. If, at step 406, controller 118 determines the VSM difference is less than or equal to the no-frost threshold, then controller 118 stops the defrost cycle at step 408 and the method ends. For example, controller 118 may end the defrost cycle by turning off the heater used to heat coil 160. If, at step 406, the VSM difference is not less than or equal to no-frost threshold, then at step 410, controller 118 determines whether the VSM difference is within a range of the no-frost threshold in some embodiments. The range be stored in memory of controller 118 and may indicate that coil 160 has such little frost accumulated that it should no longer result in a blocked condition. For example, although the no-frost threshold is 0.03 inches of water, the range may be 0.01-0.05 inches of water, such that values up to 0.05 inches of water may be within the range and indicate that there is little to no frost on coil 160. If, at step 410, controller 118 determines the VSM difference is not within the range of no-frost threshold, the method returns to step 406 and continues the defrost cycle. If, at step 410, controller 118 determines the VSM difference is within a range of the no-frost threshold, then at step 412 controller 118 ends the defrost cycle. In some embodiments, step 408 can be performed using one or more of the techniques discussed above with respect to step 412.

Steps 414-418 allow HVAC system 100 and aspects related to the defrost cycle to be updated. At step 414, in some embodiments, controller 118 may update the no-frost threshold. In some embodiments, as coil 160 accumulates dirt, the base line VSM when there is no frost may continuously increase. For example, at a first time period (e.g., when leaving the manufacturer), the no-frost threshold may be a VSM of 0 indicating that there is no frost on coil 160. However, over a period of time, (e.g., a few months to a few years) coil 160 may accumulate dirt such that the VSM of coil 160 is below a dirt threshold (e.g., does not yet need to be cleaned), but the VSM value when there is no frost on coil 160 increases. This increase of the VSM may affect the no-frost threshold. Thus, the no-frost threshold is a relative measurement of the VSM (e.g. static pressure) across coil 160 that can be updated as coil 160 becomes dirty or is otherwise fouled. This updating of the no-frost threshold may prevent controller 118 from determining frost on coil 160 and unnecessarily initiating a defrost cycle when there is actually no frost on coil 160. This conserves valuable resources and energy by preventing an unnecessary defrost cycle.

At step 416, in some embodiments, controller 118 updates the temperature setting for the defrost cycle. For example, if the defrost cycle running at a temperature of 50 degrees Fahrenheit only allows the VSM to come within a range of a no-frost threshold (e.g., as determined at step 410), rather than being less than or equal to the no-frost threshold (e.g., as would be determined at step 406), controller 118 may increase the temperature of the defrost cycle for the next iteration. At step 418, in some embodiments, controller 118 may update the runtime for the defrost cycle. Similarly to step 416, if the VSM difference does not become less or equal to the no-frost threshold, controller 118 may have the defrost cycle run for a longer period of time for the next iteration. For example, it may increase the period of time from four minutes to six minutes to ensure that the frost on coil 160 is removed. After this the method ends.

Modifications, additions, or omissions may be made to the methods described in FIG. 4 without departing from the scope of the disclosure. For example, the steps may be combined, modified, or deleted where appropriate, and additional steps may be added. For example, if controller 118 determines that the VSM is less than the no-frost threshold at step 406, then steps 410-418 may be omitted. Additionally, the steps may be performed in any suitable order without departing from the scope of the present disclosure. While discussed as controller 118 performing the steps, any suitable component of HVAC system 100 may perform one or more of the steps.

The invention claimed is:

1. A controller for a heating, ventilating, and cooling (HVAC) system, comprising:

an interface configured to receive feedback data from a fan of the HVAC system;

a memory operable to store a fan model and a plurality of thresholds; and a processor communicatively coupled to the memory and the interface, the processor operable to:

determine a virtual sensor measurement based at least in part upon the feedback data from the fan and the fan model, the virtual sensor measurement indicating the static pressure across a coil of the HVAC system;

determine that the virtual sensor measurement is greater than at least one of a group consisting of a frost threshold and a fouling threshold;

in response to determining that the virtual sensor measurement is greater than at least one of a group consisting of the frost threshold and the fouling threshold, determine a blocked condition on the coil;

determine that the virtual sensor measurement is greater than the frost threshold;

determine that an outdoor temperature is less than a freezing threshold;

determine that the HVAC system is running a heating mode;

in response to determining that the virtual sensor measurement is greater than the frost threshold and that the outdoor temperature is less than the freezing threshold and that the HVAC system is running in a heating mode, determine that the blocked condition on the coil is a frosted coil; and in response to determining that the blocked condition on the coil is the frosted coil, instruct the HVAC system to initiate a defrost cycle.

2. The controller of claim 1, the processor further operable to:

determine that the virtual sensor measurement is greater than the fouling threshold;

in response to determining that the virtual sensor measurement is greater than the fouling threshold, determine that the blocked condition on the coil is a fouled coil; and generate an alert that the coil is fouled.

3. The controller of claim 1, the processor further operable to:

determine that the virtual sensor measurement is greater than the frost threshold at a first time;

in response to determining that the virtual sensor measurement is greater than the frost threshold, initiate a defrost cycle at a second time;

determine that the virtual sensor measurement is equal to or less than a no-frost threshold at a third time, the third time being after the first time and the second time; and in response to determining that the virtual sensor measurement is equal to or less than a no-frost threshold at the third time, end the defrost cycle.

4. The controller of claim 1, the processor further operable to:

determine that the virtual sensor measurement is greater than the frost threshold at a first time;

in response to determining that the virtual sensor measurement is greater than the frost threshold, initiate a defrost cycle at a second time;

determine that the virtual sensor measurement is within a range of a no-frost threshold at a third time, the third time being after the first time and the second time;

in response to determining that the virtual sensor measurement is equal to or less than a no-frost threshold at the third time, end the defrost cycle; and update the no-frost threshold based on the virtual sensor measurement at the third time.

5. The controller of claim 1, wherein the processor is further operable to, in response to determining a blocked condition on the coil, generate an alert indicating that there is a blocked condition on the coil.

6. The controller of claim 1, wherein the frost threshold and the fouling threshold depend at least in part upon the speed of the fan.

7. A heating, ventilation, and air-conditioning (HVAC) system, comprising:

an outdoor unit, the outdoor unit comprising a fan and a coil; and a controller communicatively coupled to the fan and the coil, the controller operable to:

receive feedback data from the fan of the HVAC system;

store a fan model and a plurality of thresholds;

determine a virtual sensor measurement based at least in part upon the feedback data from the fan and the fan model, the virtual sensor measurement indicating the static pressure across the coil;

determine that the virtual sensor measurement is greater than at least one of a group consisting of a frost threshold and a fouling threshold;

in response to determining that the virtual sensor measurement is greater than at least one of a group consisting of the frost threshold and the fouling threshold, determine a blocked condition on the coil;

determine that the virtual sensor measurement is greater than the frost threshold;

determine that an outdoor temperature is less than a freezing threshold;

determine that the HVAC system is running a heating mode;

in response to determining that the virtual sensor measurement is greater than the frost threshold and that the outdoor temperature is less than the freezing threshold and that the HVAC system is running in a heating mode, determine that the blocked condition on the coil is a frosted coil; and in response to determining that the blocked condition on the coil is the frosted coil, instruct the HVAC system to initiate a defrost cycle.

8. The system of claim 7, the controller further operable to:

determine that the virtual sensor measurement is greater than the fouling threshold;

in response to determining that the virtual sensor measurement is greater than the fouling threshold, determine that the blocked condition on the coil is a fouled coil; and generate an alert that the coil is fouled.

9. The system of claim 7, the controller further operable to:

determine that the virtual sensor measurement is greater than the frost threshold at a first time;

in response to determining that the virtual sensor measurement is greater than the frost threshold, initiate a defrost cycle at a second time;

determine that the virtual sensor measurement is equal to or less than a no-frost threshold at a third time, the third time being after the first time and the second time; and in response to determining that the virtual sensor measurement is equal to or less than a no-frost threshold at the third time, end the defrost cycle.

10. The system of claim 7, the controller further operable to:

determine that the virtual sensor measurement is greater than the frost threshold at a first time;

in response to determining that the virtual sensor measurement is greater than the frost threshold, initiate a defrost cycle at a second time;

determine that the virtual sensor measurement is within a range of a no-frost threshold at a third time, the third time being after the first time and the second time;

in response to determining that the virtual sensor measurement is equal to or less than a no-frost threshold at the third time, end the defrost cycle; and update the no-frost threshold based on the virtual sensor measurement at the third time.

11. The system of claim 7, wherein the controller is further operable to, in response to determining a blocked condition on the coil, generate an alert indicating that there is a blocked condition on the coil.

12. The system of claim 7, wherein the frost threshold and the fouling threshold depend at least in part upon the speed of the fan.

13. A non-transitory computer readable storage medium comprising instructions, the instructions, when executed by a processor, executable to:

receive feedback data from the fan of the HVAC system;

store a fan model and a plurality of thresholds;

determine a virtual sensor measurement based at least in part upon the feedback data from the fan and the fan model, the virtual sensor measurement indicating the static pressure across a coil of the HVAC system;

determine that the virtual sensor measurement is greater than at least one of a group consisting of a frost threshold and a fouling threshold;

in response to determining that the virtual sensor measurement is greater than at least one of a group consisting of the frost threshold and the fouling threshold, determine a blocked condition on the coil;

determine that the virtual sensor measurement is greater than the frost threshold;

determine that an outdoor temperature is less than a freezing threshold;

determine that the HVAC system is running a heating mode;

in response to determining that the virtual sensor measurement is greater than the frost threshold and that the outdoor temperature is less than the freezing threshold and that the HVAC system is running in a heating mode, determine that the blocked condition on the coil is a frosted coil; and in response to determining that the blocked condition on the coil is the frosted coil, instruct the HVAC system to initiate a defrost cycle.

14. The non-transitory computer readable storage medium of claim 13, wherein the instructions are further operable to:

determine that the virtual sensor measurement is greater than the fouling threshold;

in response to determining that the virtual sensor measurement is greater than the fouling threshold, determine that the blocked condition on the coil is a fouled coil; and generate an alert that the coil is fouled.

15. The non-transitory computer readable storage medium of claim 13, wherein the instructions are further operable to:

determine that the virtual sensor measurement is greater than the frost threshold at a first time;

in response to determining that the virtual sensor measurement is greater than the frost threshold, initiate a defrost cycle at a second time;

determine that the virtual sensor measurement is equal to or less than a no-frost threshold at a third time, the third time being after the first time and the second time; and in response to determining that the virtual sensor measurement is equal to or less than a no-frost threshold at the third time, end the defrost cycle.

16. The non-transitory computer readable storage medium of claim 13, wherein the instructions are further operable to:

determine that the virtual sensor measurement is greater than the frost threshold at a first time;

in response to determining that the virtual sensor measurement is greater than the frost threshold, initiate a defrost cycle at a second time;

determine that the virtual sensor measurement is within a range of a no-frost threshold at a third time, the third time being after the first time and the second time;

in response to determining that the virtual sensor measurement is equal to or less than a no-frost threshold at the third time, end the defrost cycle; and update the no-frost threshold based on the virtual sensor measurement at the third time.

17. The non-transitory computer readable storage medium of claim 13, wherein the instructions are further operable to, in response to determining a blocked condition on the coil, generate an alert indicating that there is a blocked condition on the coil.

* * * * *